United States Patent [19]

Stepp

[11] 4,429,929

[45] Feb. 7, 1984

[54] PORTABLE TUBE HOLDER

[76] Inventor: J. Fred Stepp, 1888 Meadow La., Walnut Creek, Calif. 94595

[21] Appl. No.: 289,479

[22] Filed: Aug. 3, 1981

[51] Int. Cl.[3] ..... B65D 5/35

[52] U.S. Cl. ..... 312/107; 312/111; 312/216; 312/244

[58] Field of Search ..... 206/443, 503, 509, 510, 206/512; 312/107, 107.5, 111, 216, 244; 248/68 R, 68 C, 68 B

[56] References Cited

U.S. PATENT DOCUMENTS

| | | | |
|---|---|---|---|
| 504,307 | 8/1893 | Roberts | 20/32 |
| 1,377,824 | 5/1921 | Forbes | 312/107 X |
| 2,871,080 | 1/1959 | Shelly | 312/107 |
| 2,872,265 | 3/1959 | Shelly | 312/107 |
| 2,916,161 | 12/1959 | Schaefer | 206/512 X |
| 2,919,017 | 12/1959 | Weber | 206/1 |
| 3,011,852 | 12/1961 | Mahan | 312/351 |
| 3,071,283 | 1/1963 | Shelly | 220/22 |
| 3,164,185 | 1/1965 | Ingoldt | 150/1.5 |
| 3,294,225 | 12/1966 | Kenyon | 206/443 X |
| 3,369,691 | 2/1968 | Wei | 206/509 X |
| 3,464,661 | 9/1969 | Alesi, Jr. | 248/68 CB |
| 3,567,298 | 3/1971 | Ambaum et al. | 312/111 |
| 3,837,447 | 9/1974 | Honan | 190/52 |
| 3,905,541 | 9/1975 | Paxton | 206/509 X |
| 3,952,870 | 4/1976 | Gasnier | 206/443 X |
| 4,291,803 | 9/1981 | Perales | 206/443 |

*Primary Examiner*—William E. Lyddane
*Assistant Examiner*—Joseph Falk
*Attorney, Agent, or Firm*—James G. O'Neill

[57] ABSTRACT

A portable holder for transporting rolled-up blueprints or other materials. The holder is comprised of at least two elongated hollow tubes fixed together at their ends by front and rear headers. A carrying handle is fixed to one of the tubes to allow a person to easily lift and transport the holder in one hand. The front header is provided with openings aligned with the hollow interior of each tube to allow materials to be inserted into or removed therefrom. The front header may be provided with hinged doors which are secured in the closed position to insure the integrity of the materials within the tubes.

Each of the headers may also be provided with projecting fingers and aligned holes on opposite side edges to enable a number of portable holders to be stacked together and held in place by the coaction of mating fingers and holes of adjacent portable holders.

5 Claims, 3 Drawing Figures

PORTABLE TUBE HOLDER

BACKGROUND OF THE INVENTION

The present invention relates generally to blueprint holders and more particularly to a portable tube holder for easily transporting and/or storing a number of rolled-up blueprints or other materials.

The most widely used methods of storing blueprints or other similar materials consists of either placing flattened blueprints in a suspension drawer in a vertical file having a number of such drawers, or the mere rolling up of the blueprints, fixing them in the rolled position, and stacking them in cubbyholes or any convenient vacant area. Means have been suggested for storing rolled-up blueprints in tubes which may be joined together with other sides. However, none of these suggested means can be used to easily store and transport a number of separated blueprints.

In addition, none of the known means for either storing and/or transporting blueprints seems to take into account the rough handling blueprints may be subjected to during transit or at a job site.

Examples of the known means for storing rolled-up blueprints are shown in U.S. Pat. Nos. 2,871,080; 2,872,265; 3,011,852; 3,071,283; and 3,567,298.

There therefore exists a need for a blueprint holder which may be used to store blueprints and which is strong and adaptable enough that it may be used to transport rolled-up blueprints in complete security, and to prevent the blueprints from being damaged during transit, or when stored and/or used at a construction or other job site.

SUMMARY OF THE INVENTION

The present invention provides an improved portable tube holder for storing or securely transporting rolled-up blueprints to and from a construction site or other installation. The portable tube holder comprises a plurality of relatively light-weight, but strong, elongated hollow tubes joined together at their ends by headers. One of the headers is provided with openings to allow rolled-up blueprints to be inserted in or taken out of the tubes. The other of the headers is solid to close the tubes and to provide a closed hollow compartment within each of the tubes.

In one embodiment of the invention, each of the openings in the header is provided with a moveable door, which door may be provided with sealing and securing means to safely hold materials in each tube during transport and/or storage. Separate blueprints may be placed in each tube, locked in the tube, and identified on the respective door, as by labelling.

In another embodiment of the portable tube holder of the present invention each of the headers is provided with a number of projecting fingers or tips on one side edge thereof, and an equal number of aligned openings formed in the opposite side edge. Therefore, when a portable tube holder of the present invention is placed on the floor or any other flat surface, another portable holder may be stacked on top of it, with the aligned fingers in one holder held in the respective openings of the other. In this manner, any number of portable holders may be stacked one on top of the other, and firmly held together by the coaction of the aligned fingers and openings in each holder.

If required, as when the tubes are very long, or are made from a material which might allow the tubes to sag, the portable tube holder of the present invention may be provided with one or more additional headers or stiffening members to provide it with the necessary rigidity and strength. These stiffening members may be made smaller than the end headers, or may be made the same size. They may also include projecting fingers and aligned openings on the same edges as those of the end headers to provide additional mating and holding surfaces when a number of holders are stacked together.

BRIEF DESCRIPTION OF THE DRAWINGS

The above and other features of the invention will be better understood from the following detailed description of the preferred embodiments illustrated in the accompanying drawing in which.

DESCRIPTION OF THE PREFERRED EMBODIMENT

Figure 1:
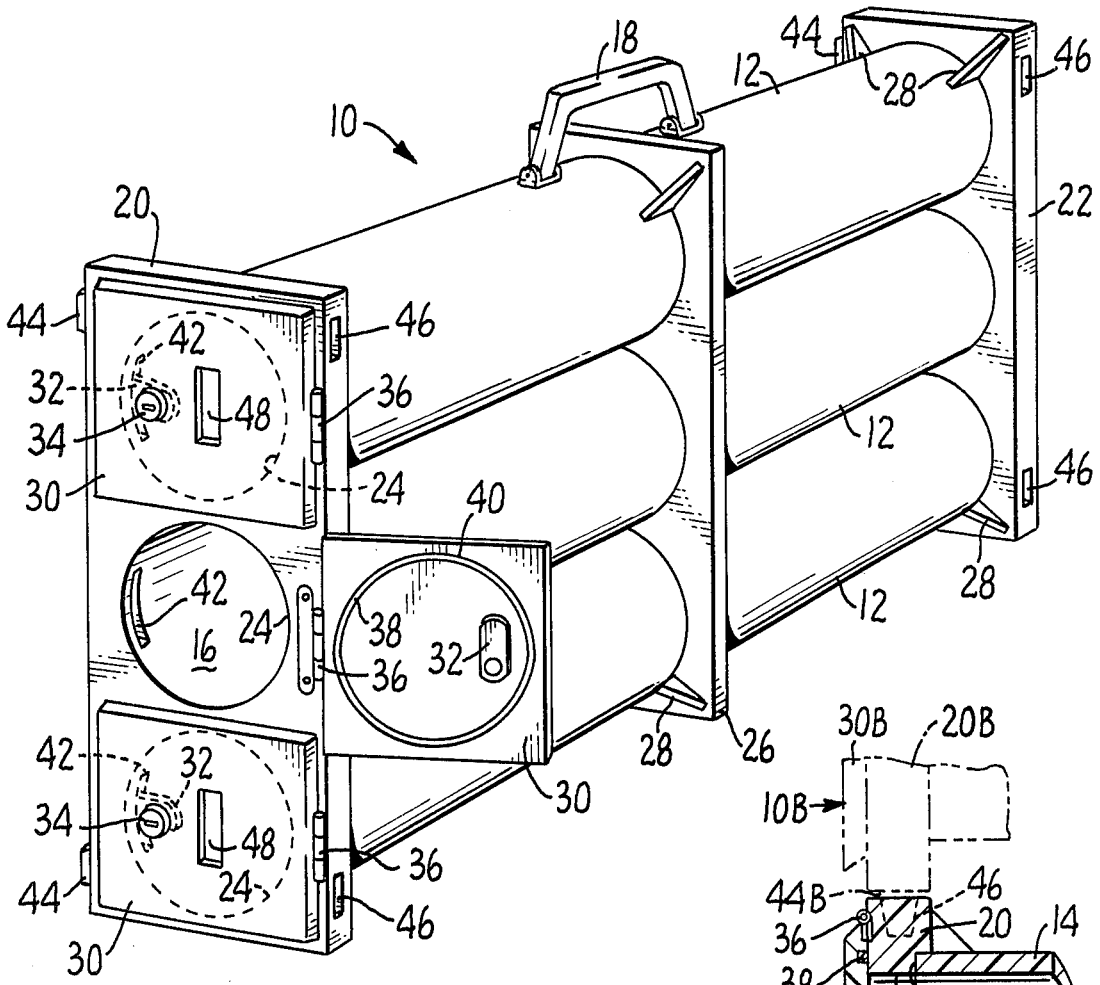
FIG. 1 is a perspective view of a portable tube holder of the present invention.

Referring now to the drawing wherein like numerals indicate like parts throughout the several figures, numeral 10 indicates a portable tube holder of the present invention. The portable holder is comprised of a plurality of spaced apart, elongated hollow tubes 12. Three tubes are shown in the drawing for illustration purposes only, it being understood that for purposes of this invention, the portable holder may be comprised of any number of tubes, with the preferred number ranging from two to eight, depending upon where and how the holder is to be used.

Figure 2:
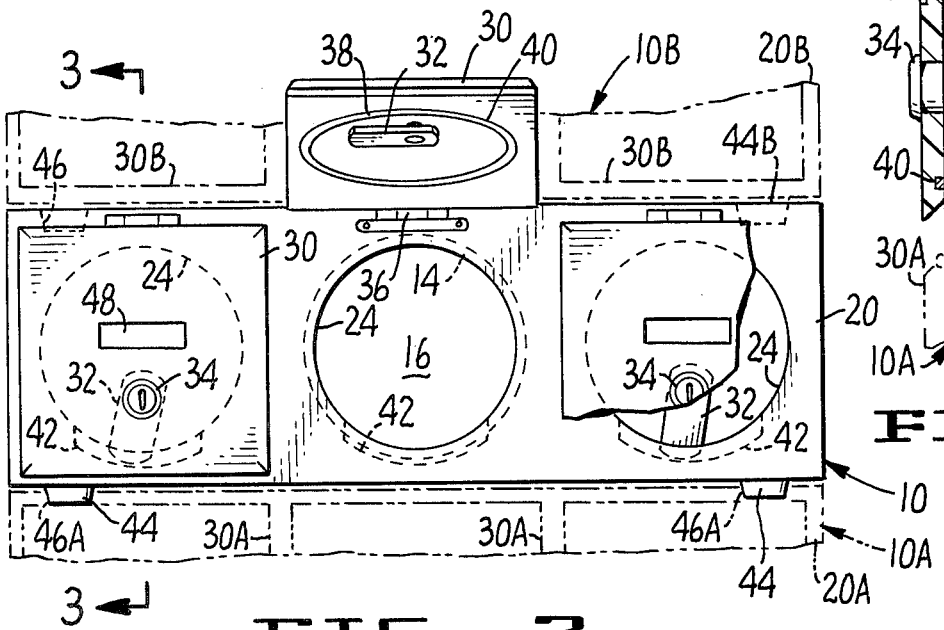
FIG. 2 is a front elevational view of the portable holder of FIG. 1 showing, in broken line, partial corresponding portable holders stacked above and below it.
Figure 3:
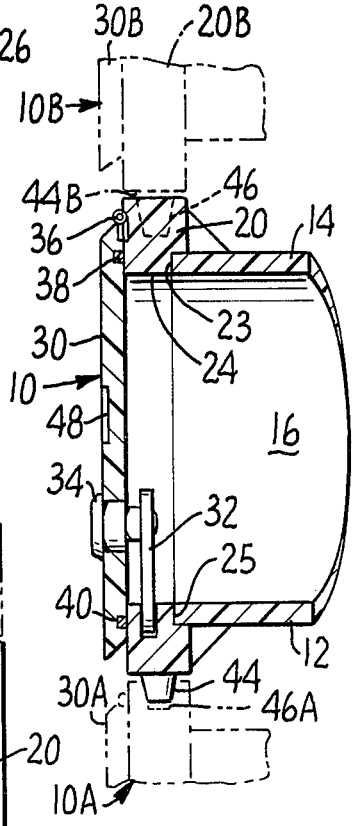
FIG. 3 is a partial sectional view taken along line 3—3 of FIG. 2.

Each of the tubes 12 is substantially circular in cross section, and as shown more clearly in FIGS. 2 and 3, has a wall 14 enclosing a hollow interior 16.

The tubes 12 are preferably made from a lightweight, strong material, such as a high-strength plastic to provide long life and to absorb shocks if dropped or handled roughly.

A handle 18 is fixed to one of the outside tubes, as by riveting, if the handle is to be permanently attached, or by some easily removable arrangement, if the handle is to be removed when the holder is used for storage. The handle is placed in such a position that a person may grasp the handle in one hand and easily lift and transport the holder and any materials contained therein.

The holder 10 is provided with headers 20 and 22 fixed to either end of each tube, and maintaining the tubes at a fixed distance from each other. Each of the headers is identical or nearly identical in size with the first or front header 20 having a plurality of openings 24 passing therethrough aligned with and providing access to the hollow interior 16 of each of the tubes. The second or rear header 22 is one piece or solid, to provide a closure or wall across the rear end of each tube.

The headers are preferably made from the same rigid material as the tubes 12, and are permanently fixed to the tubes, in any convenient manner, to form sealed, weatherproof connections which prevent the passage of air and/or moisture between the ends of each tube and the headers. As shown more clearly in FIG. 3, each tube 12 has a front end 23 fitted into and sealed in a recess 25 formed in the back face of the front header 20. The rear end of each tube is sealed to the front face of the rear header 22 in the same manner.

Depending on the length of the tubes, the holder may be provided with any number of further headers or stiffening members 26 to provide support for the tubes and to give the necessary overall rigidity to the holders. These stiffening members may be the same size or may be smaller than the front and rear headers 20, 22. In addition, to add further strength, webs 28 may be fixed between each corner of the headers 20, 22 and 26, and at least the outside tubes 12.

To enable the portable holder of the present invention to more easily and securely transport rolled-up blueprints, the front header 20 is provided with doors 30 aligned with and covering each opening 24. Each of the doors is provided with securing means, such as a latch 32, opened and closed by a key operated lock 34 and cooperating with a slot 42 formed within the opening 24.

The doors are detachably mounted on the front face of the front header 20 in any convenient manner, as by a hinge 36 removably fixed between the header 20 and each door. A sealing means, such as a circular O-ring seal 38, larger than the openings 24, is held in a groove 40 on the inside of each door. In this manner, when the doors are in the closed position, with the latches 32 locked in the complementary slots 42, the circular seals will be forced against the front face of the header 20 to provide a weatherproof seal around each opening.

Both the front header 20 and the rear header 22 are provided with a number of projecting fingers 44 on one side edge thereof. These fingers may be formed integrally with the side edge. An equal number of aligned holes 46 are formed in the opposite side edge of each header.

As shown more clearly in FIGS. 2 and 3, when the portable holder 10 of FIG. 1 is stacked upon a similar holder 10A, and a further holder 10B is stacked upon the holder 10, all of the holders will be accurately aligned and firmly held together. This is caused by the projecting fingers 44 of both the front and rear headers of holder 10 entering into and being firmly held in or interlocked with the aligned holes 46A of the lower holder 10A. At the same time, the projecting fingers 44B of the upper holder 10B will be firmly seated in the holes 46 of the holder 10 to form a three tiered stack of holders firmly interlocked together.

Any number of holders may be stacked together in one manner described above to form a convenient filing cabinet with lockable enclosures for securely storing rolled-up blueprints. Also, if the stacked holders are to be permanently left in the stacked position, some or all of the doors 30 may be quickly removed to allow ready access to the hollow interiors of some or all of the tubes 12.

The front of each door 30 may be provided with a depression 48 or the like to allow a removable label to be affixed to the door to identify the contents of each tube.

When used to transport rolled-up blueprints or other materials, the rolled-up blueprints are selectively placed in the separate tubes 12 and the doors 30 locked in position. An identifying label may then be applied to each door. The portable holder, which is sufficiently strong to resist heavy abuse may then be thrown in the trunk of a car or the back of an open pickup to be taken to a construction or other job site. Should the portable holder with the blueprints contained therein be subjected to rough handling, inclement weather or accidental immersion in water, the strong weatherproof construction of the portable holder will protect the contents of each tube. In addition, the locked door on the front of each tube will prevent the accidental loss of materials of each tube, as well as unauthorized removal of such materials.

At the job site, the rolled-up blueprints may be easily removed by authorized personnel by merely unlocking the respective doors.

By using one or several portable holders of the present invention to both transport and store materials, the need for separate shipping containers and extra files or filing space together with the attendant cost may be eliminated in many circumstances. There are many other advantages of the portable holder of the present invention, too numerous to be mentioned.

While the invention has been described in considerable detail, it is not to be limited to such details as have been set forth except as may be necessitated by the appended claims.

What is claimed is:

1. A portable tube holder comprising at least two elongated tubes, each of said tubes having two open ends, a surrounding wall, and a hollow interior;

a single front header permanently sealed to one end of each tube to fixedly hold said one end of each tube thereto in a spaced apart relationship, said front header being provided with a plurality of openings extending therethrough, said openings being equal in number to said tubes, and each of said openings being aligned with said hollow interior of one of said tubes to allow materials to be placed in and removed from said hollow interior of each tube;

a single, solid rear header permanently sealed to the other end of each tube to fixedly hold said other end of each tube thereto in a spaced apart relationship, and to form an end wall for each tube;

a carrying handle attached to one of said tubes to allow said portable holder to be lifted and transported; and a plurality of moveable doors removeably mounted on said front header, with each door being in aligned relationship with one of said openings, and locking securing means held in each of said doors and cooperating with said aligned tube whereby each of said doors may be selectively locked in position covering said aligned opening.

2. The portable holder of claim 1 wherein each of said doors is provided with sealing means whereby when each of said door is in the locked position, said hollow interior of each tube will be weatherproofed to protect the contents thereof.

3. The portable holder of claim 1 or 2 wherein each of said front and rear headers includes a front face, a rear face, and a number of side edges, said tubes being fixed to the rear face of said front header and the front face of said rear header, a plurality of fingers projecting from one side edge of each header, and an equal number of aligned holes formed in the opposite side edge of each header, said portable holder being adapted to be stacked on and securely held on the top of other portable holders by the coaction of the projecting fingers of one portable holder entering into and being held by the holes of the other portable holder.

4. The portable holder of claim 1 wherein each of said front and rear headers includes a front face, a rear face, and a number of side edges, said tubes being fixed to the rear face of said front header and the front face of said rear header, at least one stiffening member secured to said tubes between said front and rear headers, a plurality of fingers projecting from one side edge of each of said headers, and an equal number of aligned holes formed in the side edge opposite said one side edge, said portable holder being adapted to be stacked on and securely held on the top of other portable holders by the coaction of the projecting fingers of one portable holder entering into and being held by the holes of the other portable holder.

5. The portable holder of claim 4 wherein there are three tubes and each of said tubes is provided with a movable door; said three tubes being permanently sealed to said front and rear headers to prevent air or moisture from entering into the hollow interior of each tube, and each of said three doors is provided with circular sealing means whereby when each of said three doors is in the locked position, said circular sealing means will be seated around the respective opening to prevent air or moisture from entering into the hollow interior of each of said tubes.

* * * * *